United States Patent [19]

Adams et al.

[11] 4,309,020

[45] Jan. 5, 1982

[54] PATCHLESS REPLACEMENT REFRACTORY INSERT FOR BASE MEMBER (STOOL) WITH MECHANICAL ANCHORING

[75] Inventors: Paul G. Adams, Birmingham, Ala.; John T. Cruell, Frankfort, Ill.

[73] Assignee: Nalco Chemical Company, Oak Brook, Ill.

[21] Appl. No.: 174,096

[22] Filed: Jul. 31, 1980

[51] Int. Cl.[3] ..... B22D 7/12

[52] U.S. Cl. ..... 249/204; 29/402.15

[58] Field of Search ..... 249/204; 164/92; 29/402.09, 402.11, 402.12, 402.14, 402.15, 402.17

[56] References Cited

U.S. PATENT DOCUMENTS

| | | | |
|---|---|---|---|
| 2,113,445 | 4/1938 | Estep | 249/83 |
| 3,547,664 | 12/1970 | Salazar | 106/65 |
| 3,874,628 | 4/1975 | Jarron et al. | 249/204 |
| 4,077,600 | 3/1978 | Gebler | 249/204 |
| 4,097,019 | 6/1978 | Connors | 249/204 |

FOREIGN PATENT DOCUMENTS

| | | | |
|---|---|---|---|
| 466937 | 7/1975 | U.S.S.R. | 249/204 |

*Primary Examiner*—Robert D. Baldwin
*Assistant Examiner*—J. Reed Batten, Jr.
*Attorney, Agent, or Firm*—John G. Premo; Robert A. Miller

[57] ABSTRACT

An ingot stool of the type upon which steel is poured comprising a rectangular slab of cast iron having a top, bottom and sides with the top having its center portion cut out, a precast ceramic stool insert adapted to fit in snug relationship with center cut out portion of the stool, at least two vertical recesses formed within the ceramic stool insert adapted to receive a nut and at least two bolts passing through the bottom of the stool and threaded into the nuts located within the vertical recesses and ceramic plugs adapted to fill the vertical recesses after the nuts have been engaged with the bolts.

2 Claims, 1 Drawing Figure

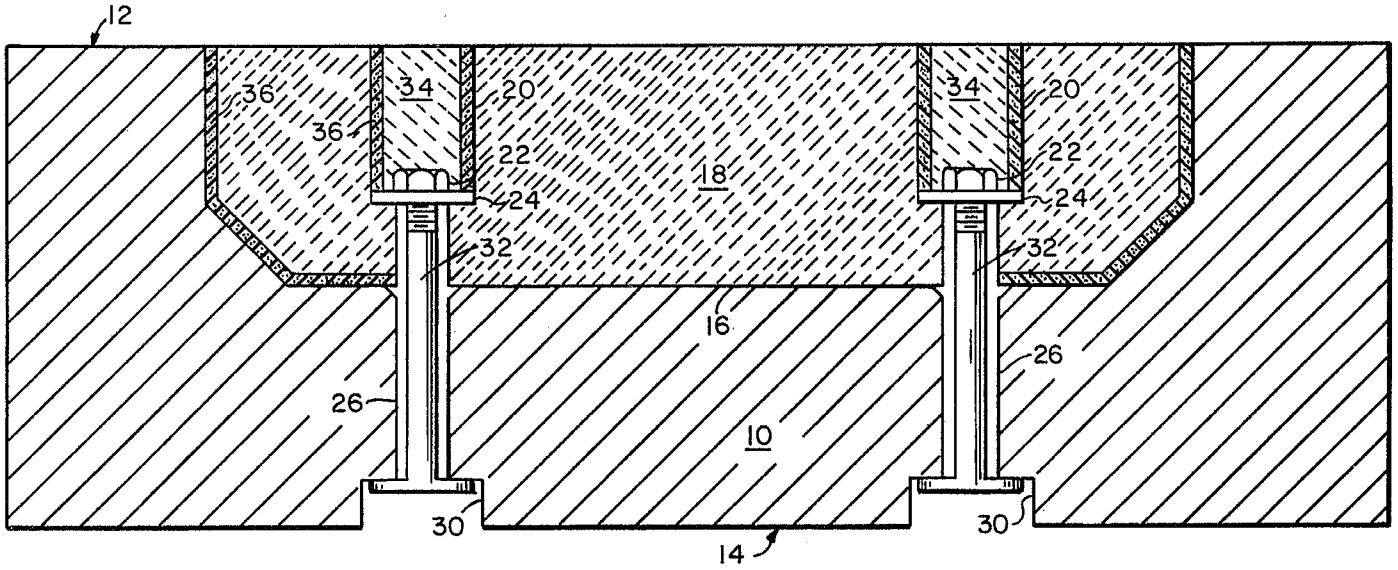
12
36
36
34
20
22
24
32
18
16
10
14
30
26
34
20
22
24
32
30
26

PATCHLESS REPLACEMENT REFRACTORY INSERT FOR BASE MEMBER (STOOL) WITH MECHANICAL ANCHORING

INTRODUCTION

1. Field of the Invention

All metal ingots are cast from molds. These molds rest on bases commonly known as "stools." The stools are large, normally rectangular, flat slabs of metal usually made of cast iron. The stools are used as support for the mold sides and also to form the bottom portion of the mold. In a "big end down" type of mold, the mold sides generally taper down in diameter from bottom to top. In another type of mold, known as the "big end up" mold, there is a ladle-like receiver for the molten metal, the bottom portion of which is an integral non-removal part of the entire mold.

Various problems commonly occur in use of these molds and particularly with respect to the surface of their base portions. The unprotected metal surface of the base portion quickly erodes and pits in the presence of molten metal which is cascaded upon its surface. Large gouges in the base portions are produced due to the force and high temperature developed by the flowing molten metal which contacts the surface of the stool.

Since many molds are generally 5–10 feet in height, the metal must be poured from a height at least equal to that distance and quite often is poured from even greater heights. A considerable pressure head is thereby developed. Thus, the hot molten metal easily gouges gaping depressions in the base members under such force and at a temperature of at least the liquefaction temperature of the molten metal. Moreover, the problem of creation of pits or gouges in the base portions of the molds, caused by the above factors, is aggravated due to the fact that the molten metal, especially near the bottom of the mold, remains in its erosive hot liquid state for a considerable amount of time subsequent to pouring.

The molten metal, after solidification to an ingot has a bottom form conforming to the undesirable eroded surface configuration of the stool or base member of the mold. Thus, a considerable amount of the ingot, when withdrawn from the mold and subsequently processed into slabs or blooms, is lost through a cropping of the irregularly formed end of the slab. This, of course, is highly undesirable, since it results in undue loss of usable metal and an increase in scrap which must be subsequently reprocessed.

Another extremely serious and costly problem arises after the ingot in the mold has solidified to a point where it can be removed from both the mold sides and its base platform member or stool. If the surface of the stool is unprotected or inadequately protected and erosion occurs as described above, the ingot has a greater tendency to remain tightly adherent to the stool. Thus, after the mold sides are removed from around the ingot, which process can normally be efficiently achieved with a minimal film of coating selected from a variety of coating agents, the ingot must be forcibly removed from the stool.

Removal is normally achieved by raising both ingot and adherent stool, and thrusting them against some other larger object whereby the ingot is jarred loose. In many cases the stool and ingot are merely dropped on the floor from some suitable height. In such a situation, the stool is often broken into two or more smaller pieces and cannot be subsequently reused in casting other ingots. Again, replacement cost of these stools is high, making this aspect of the overall casting process somewhat disadvantageous. The same problem exists with respect to big end up molds wherein sticking of ingots particularly occurs at their base portion. New molds of this type are especially vulnerable to sticking due to their smooth surface unprotected by any layers of metal oxides or scale. A tight metal-to-metal bond between mold bottoms and ingots may occur in this situation.

Cracking of molds and, particularly, cracking of their base portions due to the above discussed rough handling occasioned by "stickers" between the base portions and ingots is enhanced by thermal shock during ingot formation. Unprotected or inadequately protected bottom surfaces of molds are especially susceptible to such destructive shock.

2. Description of the Prior Art

Many ways of alleviating the above described problems in connection with the erosion of base members of ingot molds have been proposed in the prior art. A number of refractory coatings have been suggested but these are not entirely satisfactory.

An early solution to the erosion of ingot mold stools resided in the suggestion that refractory inserts could be replaced into the bottom of the mold, which refractory would tend to minimize erosion.

An important drawback of ceramic inserts relates to the difficulty of anchoring them to the stools. Molten metal tends to work its way into the space between the insert and the stool. In the absence of a sufficient anchoring system, this molten metal tends to force the ceramic insert from its cavity. When this occurs, the ceramic insert positions itself above the top surface of the stool and tends to become entrained within the metal ingot. This entrainment causes a number of problems including the formation of metal inclusions in the ingot which necessitate an expensive operation known as butt cropping.

Many of the deficiencies in the prior art mentioned above have been overcome by utilizing precast ceramic inserts. In one instance, the cast iron stool is cast onto a preformed ceramic stool insert which makes the insert integral with the stool. This is disclosed in U.S. Pat. No. 4,097,019. Another method of utilizing precast ceramic inserts is disclosed in U.S. Pat. No. 4,077,600. In this patent a preformed insert is put into a large performed cavity in the stool. It is anchored into the stool by means of Z-shaped brackets which are anchored into the body of the cavity and with the top portion of such anchors fitting into a preformed groove in the ceramic insert.

In the case of the ceramic inserts taught in U.S. Pat. No. 4,097,019, these can be prepared only at the foundry where the stools are made. In the case of U.S. Pat. No. 4,077,600, the ceramic inserts require extensive labor to fasten the inserts and, also, the spaces between the insert and the stool must be filled or plugged with additional refractory material.

THE DRAWING

The drawing is a vertical cross-sectional view showing a preferred embodiment of the invention.

THE INVENTION

With particular reference to the drawing, there is shown a cast iron stool 10 having a top 12 and a bottom 14. The center portion of the top 12, which portion is where the molten metal is teemed onto the stool, is cut out. This cut out portion 16 is fitted with a precast ceramic stool insert 18 which is dimensioned to fit exactly into cut out portion 16.

The insert 18 contains two or more vertical recesses 20 adapted to receive nuts 22 and, optionally, washers 24.

The bottom 14 of the stool contains vertical openings 26 having recessed stops 30. The openings 26 and the recessed stops are fitted with conventional T-headed bolts 32 which engage the nuts 22. The bolts are threaded into the nuts and snugged up so that the ceramic insert 18 is fastened securely to the stool 10.

After the bolts and nuts are snugged, they are covered with a ceramic plug 34. The ceramic plugs 34 and the sides of the insert are optionally fitted with a gasket 36 which may be formed with the plastic refractory disclosed in U.S. Pat. No. 3,547,664.

Thus, by using this technique, it is possible to use simple fastening means to fasten a stool insert within a stool having a preformed cavity while, at the same time, preventing any movement of the insert within the stool.

The refractory insert is formed from many common refractory materials although preferably the refractory material will be composed predominantly of alumina, a binder and filler materials including vitreous silica, crystalline silica, magnesium silicate, aluminum silicate, graphite, zirconium silicate and clay. The preferred refractory material should contain 40–95% alumina, 5–20% binder and the remainder filler.

Typical binders include a mixture of water and one or more of ethyl silicate, sodium silicate, aluminum phosphate, colloidal silica or clay, where water comprises up to 50% by weight of the binder. In a most preferred embodiment, the refractory insert will be formed from a refractory mixture containing at least 70% by weight alumina, 10% by weight ethyl silicate, 10% by weight water and the remainder crystalline silica. Another, a less desirable insert, could be formed from about 50% silicon carbide, about 20% silica, about 10% alumina and the remainder binder.

According to the practice of the present invention, the refractory insert will be formed by mixing the materials described above, forming them into a parallel face geometric shape and subjecting them to heating. The temperature and length of heating will depend upon the refractories and the binders used. In a preferred mixture containing 70% alumina, 10% binder, 10% water and the remainder silica, the mixture should be shaped and then subjected to 2000°–2500° F. for at least one hour and, preferably, for three hours or more before use.

Having thus described our invention, it is claimed as follows:

1. An ingot stool of the type upon which steel is poured comprising a rectangular slab of cast iron having a top, bottom and sides with the top having a center portion cut out, a precast ceramic stool insert fitted in snug relationship with the center cut out portion of the stool, at least two vertical stepped recesses formed within the ceramic stool insert, each recess having a nut received therein, and supported by the stepped portion of said recess, at least two bolts passing through the bottom of the stool and threaded into the nuts located within the vertical recesses and ceramic plugs filling the vertical recesses above the nuts.

2. The ingot stool of claim 1 further comprising gasketing material between the cut out portion of the stool and the ceramic insert.

* * * * *